US010687140B2

(12) United States Patent
Hua et al.

(10) Patent No.: US 10,687,140 B2
(45) Date of Patent: Jun. 16, 2020

(54) METHOD FOR ENHANCING NOISE REDUCTION AMOUNT OF FEEDBACK ACTIVE NOISE REDUCTION HEADPHONE, AND ACTIVE NOISE REDUCTION HEADPHONES

(71) Applicant: Qingdao GoerTek Technology Co., Ltd., Qingdao (CN)

(72) Inventors: Yang Hua, Qingdao (CN); Peng Li, Qingdao (CN); Ruohui Wang, Qingdao (CN)

(73) Assignee: Qingdao GoerTek Technology Co., Ltd., Qingdao (CN)

( * ) Notice: Subject to any disclaimer, the term of this patent is extended or adjusted under 35 U.S.C. 154(b) by 0 days.

(21) Appl. No.: 15/751,904

(22) PCT Filed: May 25, 2016

(86) PCT No.: PCT/CN2016/083320
§ 371 (c)(1),
(2) Date: Feb. 12, 2018

(87) PCT Pub. No.: WO2017/024855
PCT Pub. Date: Feb. 16, 2017

(65) Prior Publication Data

US 2018/0242082 A1 Aug. 23, 2018

(30) Foreign Application Priority Data

Aug. 11, 2015 (CN) ..... 2015 1 0489141

(51) Int. Cl.
*H04R 3/02* (2006.01)
*H04R 1/10* (2006.01)
(Continued)

(52) U.S. Cl.
CPC ..... *H04R 3/02* (2013.01); *G10K 11/178* (2013.01); *G10K 11/17813* (2018.01);
(Continued)

(58) Field of Classification Search
CPC ... H04R 3/02; H04R 3/04; H04R 1/10; H04R 1/1008; H04R 1/1083; H04R 2460/01;
(Continued)

(56) References Cited

U.S. PATENT DOCUMENTS 6,412,593 B1 * 7/2002 Jones ..... H04R 1/1008 181/129
7,466,838 B1 * 12/2008 Moseley ..... G10K 11/178 381/370
(Continued)

FOREIGN PATENT DOCUMENTS

CN 102413403 A 4/2012
CN 102447992 A 5/2012
(Continued)

OTHER PUBLICATIONS

Japanese Patent Office, Notice of Allowance in Application No. 2018-506567 dated Jul. 27, 2018.
(Continued)

*Primary Examiner* — Davetta W Goins
*Assistant Examiner* — Daniel R Sellers
(74) *Attorney, Agent, or Firm* — LKGlobal | Lorenz & Kopf, LLP

(57) ABSTRACT

Disclosed are a method for enhancing noise reduction amount of a feedback active noise reduction headphone and active noise reduction headphones. The method includes: arranging a noise reduction microphone of the feedback active noise reduction headphone at a position away from directly in front of a loudspeaker; and adjusting a relative position between the noise reduction microphone and an ear
(Continued)

canal opening of a wearer, and enabling an open-loop transfer function at the ear canal opening L2(s0) and an open-loop transfer function at the noise reduction microphone L1(s0) to satisfy a relation of |L2(s0)|>|L1(s0)|, to enhance an actual noise reduction amount at the ear canal opening.

8 Claims, 4 Drawing Sheets

(51) Int. Cl.
*G10K 11/178* (2006.01)
*H04R 3/04* (2006.01)

(52) U.S. Cl.
CPC .. *G10K 11/17857* (2018.01); *G10K 11/17875* (2018.01); *H04R 1/10* (2013.01); *H04R 1/1008* (2013.01); *H04R 1/1083* (2013.01); *H04R 3/04* (2013.01); *G10K 11/17819* (2018.01); *H04R 2460/01* (2013.01)

(58) Field of Classification Search
CPC ..... G10K 11/178; G10K 11/1781; G10K 11/17813; G10K 11/17817
See application file for complete search history.

(56) References Cited

U.S. PATENT DOCUMENTS

| | | | | |
|---|---|---|---|---|
| 2006/0251266 | A1* | 11/2006 | Saunders | G10K 11/178 381/71.1 |
| 2007/0206825 | A1 | 9/2007 | Thomasson | |
| 2008/0112569 | A1* | 5/2008 | Asada | G10K 11/178 381/71.1 |
| 2008/0187148 | A1 | 8/2008 | Itabashi et al. | |
| 2011/0249826 | A1 | 10/2011 | Van Leest | |
| 2012/0057718 | A1 | 3/2012 | Vernon | |
| 2012/0087509 | A1 | 4/2012 | Elmedyb | |
| 2013/0028440 | A1* | 1/2013 | Perkmann | G10K 11/178 381/94.1 |
| 2013/0058493 | A1 | 3/2013 | Darlington et al. | |
| 2013/0070936 | A1 | 3/2013 | Jensen et al. | |
| 2013/0129105 | A1 | 5/2013 | Parrot | |
| 2015/0010164 | A1* | 1/2015 | Christoph | G10K 11/178 381/71.6 |

FOREIGN PATENT DOCUMENTS

| | | | |
|---|---|---|---|
| CN | 102769816 | A | 11/2012 |
| CN | 103024633 | A | 4/2013 |
| CN | 101242677 | A | 8/2013 |
| CN | 103748903 | A | 4/2014 |
| CN | 104081452 | A | 10/2014 |
| CN | 105049979 | A | 11/2015 |
| EP | 2597889 | A | 5/2013 |
| EP | 2624251 | A | 8/2013 |
| EP | 2728906 | A1 | 5/2014 |
| JP | 2012513035 | A | 10/2011 |
| WO | 2000006066 | A1 | 2/2000 |

OTHER PUBLICATIONS

European Patent Office, Search Report in Application No. 16834480.2 dated Jul. 20, 2018.
European Patent Office, Examination Report in Application No. 16834480.2 dated Sep. 27, 2018.
International Bureau of WIPO, International Search Report and Written Opinion in Application No. PCT/CN2016/083320 dated Jul. 26, 2016.
Chinese Patent Office, Examination Report in Application No. 201510489141.9 dated Nov. 2, 2017.
Yan, Xinye; Lu, Jing; Qiu, Xiaojun; Study of Applying High-frequency Constraints on Feedback Active Noise Reduction Headset, dated May 2013.

* cited by examiner

METHOD FOR ENHANCING NOISE REDUCTION AMOUNT OF FEEDBACK ACTIVE NOISE REDUCTION HEADPHONE, AND ACTIVE NOISE REDUCTION HEADPHONES

CROSS REFERENCE TO RELATED APPLICATIONS

This application is a U.S. National-Stage entry under 35 U.S.C. § 371 based on International Application No. PCT/CN2016/083320, filed on May 25, 2016, which was published under PCT Article 21(2) and which claims priority to Chinese Patent Application No. 201510489141.9, filed on Aug. 11, 2015, which are all hereby incorporated herein in their entirety by reference.

TECHNICAL FIELD

This Application pertains to the technical field of active noise reduction, and particularly relates to a method for enhancing noise reduction amount of a feedback active noise reduction headphone and active noise reduction headphones.

BACKGROUND ART

Feedback active noise reduction headphones include supra-aural headphones and circum-aural headphones. The open-loop transfer function of supra-aural headphones has poor stability. In designing the feedback noise reduction, the stability in various situations should be considered, and the noise reduction amount of the headphones has to be sacrificed to ensure stability. In addition, a significant characteristic of supra-aural headphones that distinguishes them from circum-aural headphones is their small volume. Installing a noise reduction microphone directly in front of a speaker will increase the thickness of supra-aural earphones or result in wearing discomfort. In conclusion, supra-aural feedback active noise reduction headphones have not been extensively used and popularized.

Circum-aural feedback active noise reduction headphones generally have a relatively large volume, so sealing is an important factor to be considered in designing. As the earmuff is airtight, a relatively rigid cavity will be formed after wearing, within which the intensive sound wave reflection will cause the howling of the feedback active noise reduction headphone. In order to absorb and decrease the sound wave reflection within the cavity, relatively thick felted wool or compressed sponge is usually used to fill the interior. The filler is distributed between a speaker and an ear canal opening of the wearer, and serves to protect the speaker and the noise reduction microphone and reduce the internal reflection of the walls, but at the same time a noise reduction amount at the ear canal opening of the wearer is considerably reduced.

It is desirable to provide a solution that addresses the above technical problems. In addition, other objects, desirable features and characteristics will become apparent from the subsequent summary and detailed description, and the appended claims, taken in conjunction with the accompanying drawings and this background.

SUMMARY

In order to solve the above technical problems, this Application provides a method for enhancing noise reduction amount of a feedback active noise reduction headphone and active noise reduction headphones.

According to one aspect of this Application, this Application provides a method for enhancing noise reduction amount of a feedback active noise reduction headphone, wherein the method comprises:

arranging a noise reduction microphone of the feedback active noise reduction headphone at a position away from directly in front of a loudspeaker; and adjusting a relative position between the noise reduction microphone and an ear canal opening of a wearer, and enabling an open-loop transfer function at the ear canal opening $L2(s0)$ and an open-loop transfer function at the noise reduction microphone $L1(s0)$ to satisfy a relation of $|L2(s0)|>|L1(s0)|$, to enhance an actual noise reduction amount at the ear canal opening.

Optionally, the step of enabling an open-loop transfer function at the ear canal opening $L2(s0)$ and an open-loop transfer function at the noise reduction microphone $L1(s0)$ to satisfy a relation of $|L2(s0)|>|L1(s0)|$ comprises:

enabling a relative quantity B of the open-loop transfer function fall inside a circle $|B+1|=1$ in a Nyquist plot of the open-loop transfer function, and B is the difference between the open-loop transfer function at the ear canal opening $L2(s0)$ and the open-loop transfer function at the noise reduction microphone $L1(s0)$.

Optionally, the method further comprises: designing the open-loop transfer function at the ear canal opening $L2(s0)$ and the open-loop transfer function at the noise reduction microphone $L1(s0)$, so that when a phase of the $L1(s0)$ and the $L2(s0)$ is even times of the circular constant $\pi$, the amplitudes of the $L1(s0)$ and the $L2(s0)$ are both controlled to be less than 1.

Optionally, when the method is applied to a supra-aural feedback active noise reduction headphone, the noise reduction microphone is arranged under an earmuff of the supra-aural feedback active noise reduction headphone, and the loudspeaker faces directly the ear canal opening of the wearer.

Optionally, when the method is applied to a circum-aural feedback active noise reduction headphone, the noise reduction microphone is arranged under a damping mat of the circum-aural feedback active noise reduction headphone, and the loudspeaker faces directly the ear canal opening of the wearer without a damping mat therebetween.

Optionally, the damping mat is formed by filling the earmuff with felted wool or compressed sponge.

According to another aspect of this Application, this Application provides an supra-aural feedback active noise reduction headphone, wherein a noise reduction microphone of the supra-aural feedback active noise reduction headphone is arranged under an earmuff which is away from directly in front of a loudspeaker, and the loudspeaker faces directly the ear canal opening of the wearer; and when the headphone is worn, a relative position between the noise reduction microphone and the ear canal opening of the wearer is adjusted, so that an open-loop transfer function at the ear canal opening $L2(s0)$ and an open-loop transfer function at the noise reduction microphone $L1(s0)$ satisfy a relation of $|L2(s0)|>|L1(s0)|$, to enhance an actual noise reduction amount at the ear canal opening.

Optionally, when a phase of the open-loop transfer function at the ear canal opening $L2(s0)$ and the open-loop transfer function at the noise reduction microphone $L1(s0)$ is even times of the circular constant $\pi$, the amplitudes of the $L1(s0)$ and the $L2(s0)$ are both less than 1.

According to yet another aspect of this Application, this Application provides a circum-aural feedback active noise reduction headphone, wherein the noise reduction microphone of the circum-aural feedback active noise reduction headphone is arranged under a damping mat which is away from directly in front of a loudspeaker, and the loudspeaker faces directly the ear canal opening of the wearer without a damping mat therebetween; and when the headphone is worn, a relative position between the noise reduction microphone and the ear canal opening of the wearer is adjusted, so that an open-loop transfer function at the ear canal opening L2(s0) and an open-loop transfer function at the noise reduction microphone L1(s0) satisfy a relation of |L2(s0)|>|L1(s0)|, to enhance an actual noise reduction amount at the ear canal opening.

Optionally, when a phase of the open-loop transfer function at the ear canal opening L2(s0) and the open-loop transfer function at the noise reduction microphone L1(s0) is even times of the circular constant π, the amplitudes of the L1(s0) and the L2(s0) are both less than 1.

The method for enhancing a noise reduction amount of a feedback active noise reduction headphone provided in this Application can effectively improve the noise reduction amount and stability of a supra-aural active noise reduction headphone, and solves the problem of thickness increase or wearing discomfort resulted from installing a noise reduction microphone directly in front of a speaker. The method can also effectively enhance a noise reduction amount at the ear canal opening of the wearer while maintaining the closed-loop stability of the feedback system in a circum-aural feedback active noise reduction headphone.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

In order to make the objects, technical solutions and advantages of this Application clearer, the embodiments of this Application will be described below in further detail in conjunction with the drawings.

First, the principle of noise reduction of the feedback system of simulative active noise reduction headphones is analyzed.

Figure 1:
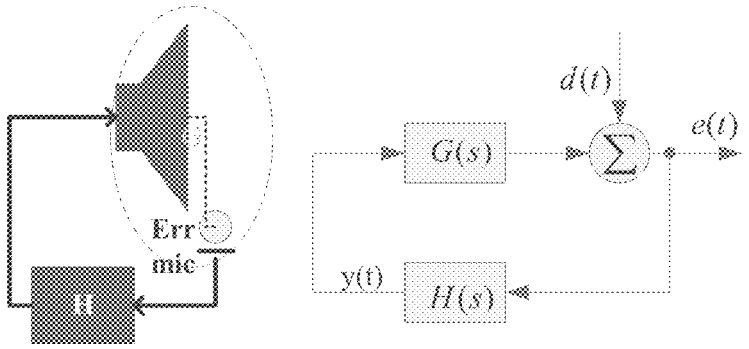
FIG. 1 is the block diagram of an ANR system of an embodiment of this Application.

FIG. 1 is the block diagram of an ANR (Active Noise Reduction) system of an embodiment of this Application. As shown in FIG. 1, G(s) is a transfer function from the speaker to the noise reduction microphone, H(s) is a control circuit, d(t) is an environmental noise signal, and e(t) is an error signal picked up by the noise reduction microphone.

The transfer function from the error signal e(t) to the environmental noise d(t) is defined as the system sensitivity function S:

$$S = \frac{E}{D} = \frac{1}{1 - GH}.$$

It can be seen that, if the error signal E is smaller, the noise reduction effect is better. The noise is reduced in the frequency band where S is less than 1, and increased in the frequency band where S is greater than 1. The noise reduction effect (noise reduction frequency band and noise reduction amount) depends on the open-loop transfer function L (L=GH).

In designing the open-loop transfer function L of the analog feedback system, the following points should be noted.

(1) Considering the stability of the closed loop system, the critical condition of no howling is that when a phase of L is even times of the circular constant π, the amplitude is less than 1. In practice the amplitude and phase must leave adequate allowances in the design process. Therefore, in designing the open-loop transfer function at the ear canal opening L2(s0) and the open-loop transfer function at the noise reduction microphone L1(s0), when a phase of the L1(s0) and the L2(s0) is even times of the circular constant π, the amplitudes of the L1(s0) and the L2(s0) are both less than 1.

(2) The waterbed effect: if the noise in some wave bands is reduced, the noise in other frequency bands is increased.

(3) The transition zone: the frequency band in which the noise transits from reducing to increasing.

(4) In addition, the phase attenuation caused by the propagation delay of the G(s) channel is increased along with the frequency increasing, which decreases the phase margin of the feedback system, and increases the difficulty in noise reduction at high frequency bands of the feedback system.

Figure 2:
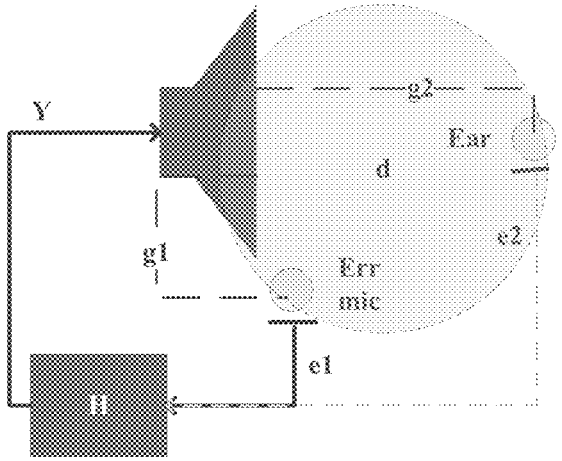
FIG. 2 is the block diagram of a simulative ANR at the ear canal opening and at the noise reduction microphone of an embodiment of this Application.

FIG. 2 is the block diagram of the simulative ANR at the ear canal opening and at the noise reduction microphone of an embodiment of this Application. As shown in FIG. 2, g1 is the transfer function of the air between the speaker and the noise reduction microphone, M1 is the sensitivity of the noise reduction microphone, e1 is the received signal, g2 is the transfer function of the air between the speaker and the ear, M2 is the sensitivity at the ear canal opening, e2 is the received signal, H is the control circuit, Y is the control signal, and R is the frequency response of the speaker. It is assumed that the sound field within the earmuff is stable at d.

At the noise reduction microphone, the sensitivity function is:

$$S_1 = \frac{e_1}{d} = \frac{1}{1 - HG_1} G_1 = g_1 R M_1.$$

At the ear canal opening, the sensitivity function is:

$$S_2 = \frac{e_2}{d} = \frac{1 + HG_2 - HG_1}{1 - HG_1} G_2 = g_2 R M_1.$$

Wherein Rg2M2 is a measured value, and a normalization factor k of the two sensitivity functions must be introduced: $G_2 = g_2 R M_2 \cdot k$ $k = M_1/M_2$.

It is defined that L1=HG1, L2=HG2, and B=L2−L1, and B is the difference between the open-loop transfer function at the ear canal opening L2(s0) and the open-loop transfer function at the noise reduction microphone L1(s0). The sensitivity function at the ear canal opening may be expressed as S2=S1*(1+B), and the residue noise amount |e2|=|e1|*|1+B|. The difference between the noise reduction effects at the ear canal opening and at the noise reduction microphone depends on the value of B.

In a frequency band where L2 and L1 are similar, the value of B approaches 0, and |1+B| approaches 1, at this point the noise reduction effects at the ear canal opening and at the noise reduction microphone are close. When B is outside the circle |B+1|=1, |e2|>|e1|, and the noise reduction effect at the ear canal opening becomes poorer than that at the noise reduction microphone. When B is inside the circle |B+1|=1, |e2|<|e1|, and the noise reduction effect at the ear canal opening becomes better than that at the noise reduction microphone.

Figure 3A:
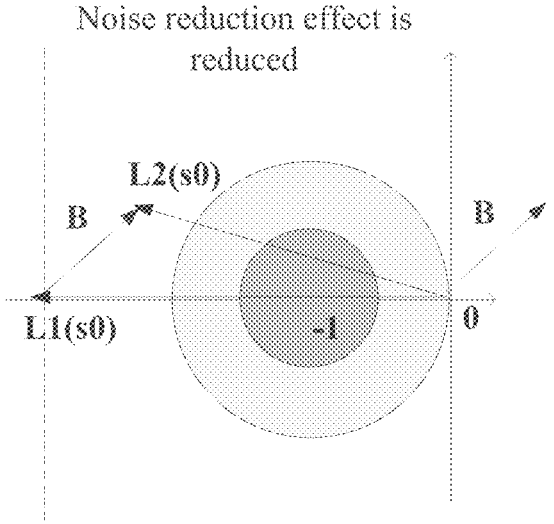
FIG. 3 is the Nyquist plot of the relative quantity B of the open-loop transfer function of an embodiment of this Application.
Figure 3B:
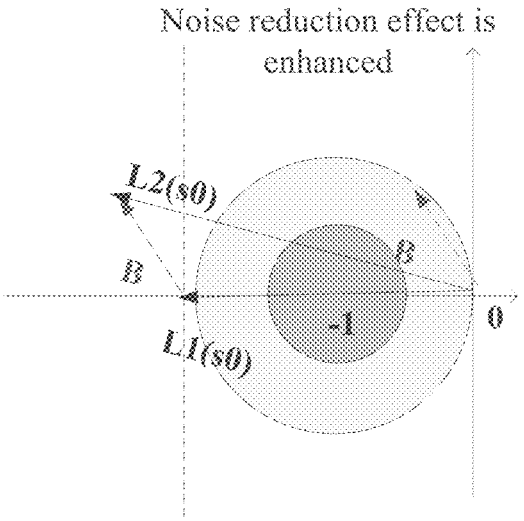

FIG. 3 is the Nyquist plot of the relative quantity B of the open-loop transfer function of an embodiment of this Application. As shown in FIG. 3, in FIG. 3(*a*), the maximum amplitude of the open-loop transfer function at the noise reduction microphone is L1(s0), the corresponding phase is at −180°, and the value of the open-loop transfer function at the ear canal opening is L2(s0). If the energy of the control signal transferred to the noise reduction microphone is stronger than that transferred to the ear canal opening, |L2(s0)|<|L1(s0)|, so no matter what the phase of L2(s0) is, B will fall into the first and fourth quadrants, at this point |1+B|>1, and the noise reduction amount at the ear canal opening is always smaller than that at the noise reduction microphone. In FIG. 3(*b*), when L2(s0) falls in the left side of the vertical line of the end of L1(s0), B may probably fall inside the circle |r+1|=1. Only if it falls inside the circle, that is, the relative quantity B of the open-loop transfer function falls inside the circle |B+1|=1 in the Nyquist plot of the open-loop transfer function, the noise reduction amount at the ear canal opening will be enhanced compared with that at the noise reduction microphone, and if the B falls inside the central small circle the noise reduction amount will increase by more than 6 dB.

Figure 4:
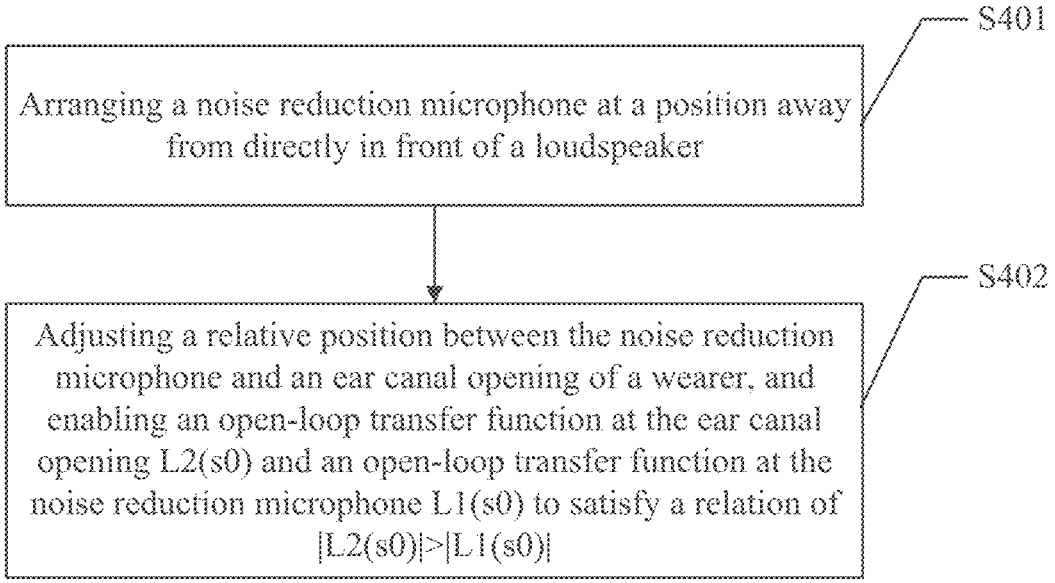
FIG. 4 is the flow process of a method for enhancing a noise reduction amount of a feedback active noise reduction headphone provided in an embodiment of this Application.

FIG. 4 is the flow process of the method for enhancing a noise reduction amount of a feedback active noise reduction headphone provided in an embodiment of this Application. As shown in FIG. 4, the method comprises:

Step 401, arranging a noise reduction microphone of the feedback active noise reduction headphone at a position away from directly in front of a loudspeaker; and Step 402, adjusting a relative position between the noise reduction microphone and an ear canal opening of a wearer, and enabling an open-loop transfer function at the ear canal opening L2(s0) and an open-loop transfer function at the noise reduction microphone L1(s0) to satisfy a relation of |L2(s0)|>|L1(s0)|, to enhance an actual noise reduction amount at the ear canal opening. After the relative position between the noise reduction microphone and the ear canal opening of the wearer is adjusted, parameters such as g1, g2, the magnitude of the damping between the speaker and the ear canal opening of the wearer, M1 and M2 are adjusted accordingly, and the transfer functions L1 and L2 change along with the adjusting of these parameters.

In Step 402, the step of enabling an open-loop transfer function at the ear canal opening L2(s0) and an open-loop transfer function at the noise reduction microphone L1(s0) to satisfy a relation of |L2(s0)|>|L1(s0)| comprises: enabling a relative quantity B of the open-loop transfer function fall inside a circle |B+1|=1 in a Nyquist plot of the open-loop transfer function, and B is the difference between the open-loop transfer function at the ear canal opening L2(s0) and the open-loop transfer function at the noise reduction microphone L1(s0).

Furthermore, considering the stability of the closed loop system, in order to avoid howling, the open-loop transfer function at the ear canal opening L2(s0) and the open-loop transfer function at the noise reduction microphone L1(s0) are designed, so that when a phase of the L1(s0) and the L2(s0) is even times of the circular constant π, the amplitudes of the L1(s0) and the L2(s0) are both controlled to be less than 1.

Because the wearing stability of supra-aural earphones is poor, which makes the stability of the acoustic paths within the ear cavity poor, the loop gain of the entire closed loop that is formed by the ANC circuit board, the SPK, the acoustic paths within the ear cavity and the MIC cannot be set too large, otherwise howling will probably happen. Therefore, when a conventional ANC design is used in a supra-aural earphone, the noise reduction amount is small, and such kind of noise reduction headphones are not commonly seen.

Figure 5:
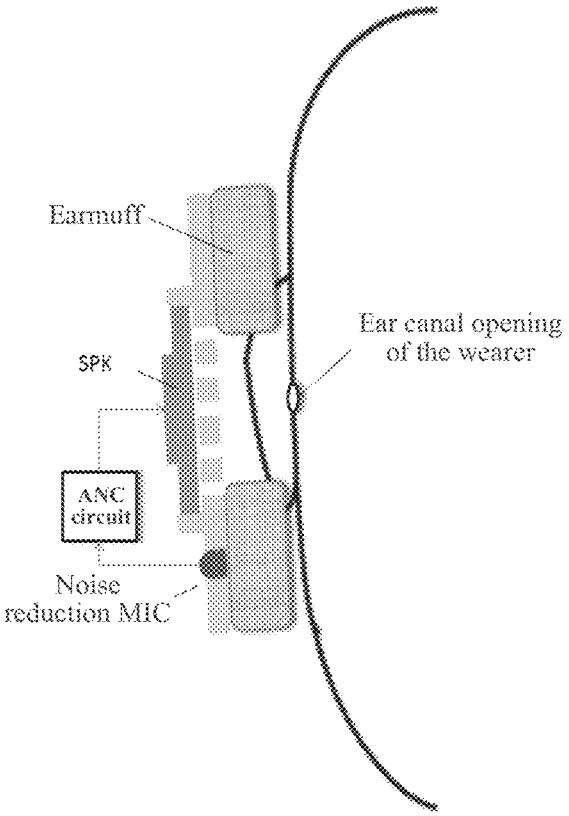
FIG. 5 is the schematic diagram of the technical solution of a supra-aural feedback active noise reduction headphone provided in an embodiment of this Application.

FIG. 5 is the schematic diagram of the technical solution of a supra-aural feedback active noise reduction headphone provided in an embodiment of this Application. As shown in FIG. 5, in the supra-aural feedback active noise reduction headphone provided in this Application, the noise reduction microphone is arranged under an earmuff which is away from directly in front of the loudspeaker, and the loudspeaker faces directly the ear canal opening of the wearer. Because part of the sound of the SPK is attenuated by the earmuff, the gain of the entire feedback loop is reduced, which facilitates the stability of the feedback loop.

When the headphone is worn, if the relative position between the noise reduction microphone and the ear canal opening of the wearer is adjusted, parameters such as g1, g2, the magnitude of the damping between the speaker and the ear canal opening of the wearer, M1 and M2 are adjusted accordingly, and the transfer functions L1 and L2 change along with the adjusting of those parameters, so that an open-loop transfer function at the ear canal opening L2(s0) and an open-loop transfer function at the noise reduction microphone L1(s0) satisfy a relation of |L2(s0)|>|L1(s0)|, to enhance an actual noise reduction amount at the ear canal opening. the open-loop transfer function at the ear canal opening L2(s0) and the open-loop transfer function at the noise reduction microphone L1(s0) are designed so that when the phase is even times of the circular constant π, the amplitudes of the L1(s0) and the L2(s0) are both controlled to be less than 1, thereby avoiding howling, and realizing the increasing of the noise reduction amount at the ear canal opening that is actually used.

Figure 6:
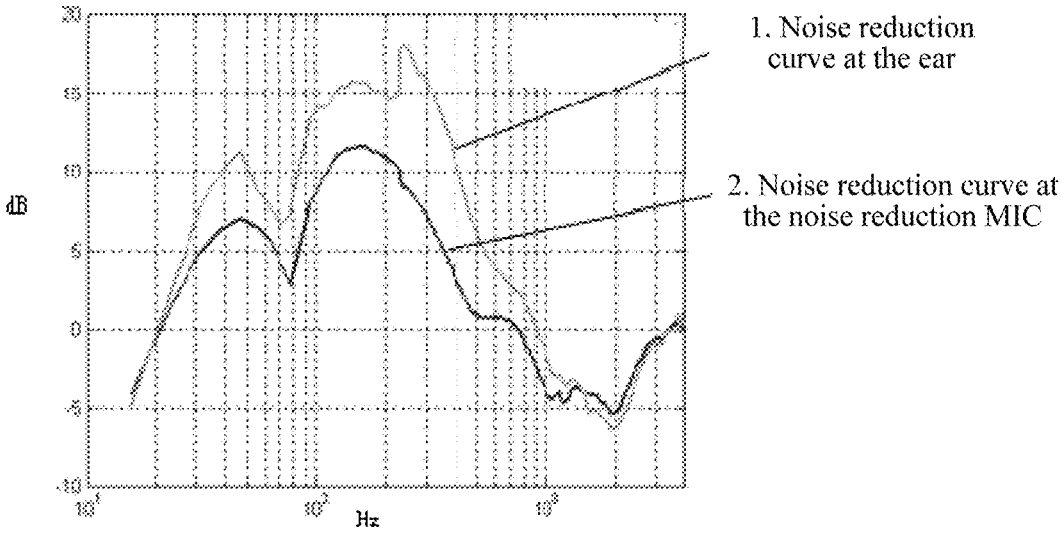
FIG. 6 is the test result of the noise reduction amount of a supra-aural feedback active noise reduction headphone provided in an embodiment of this Application.

FIG. 6 is the test result of the noise reduction amount of a supra-aural feedback active noise reduction headphone provided in an embodiment of this Application. As shown in FIG. 6, the curve at the bottom with lesser noise reduction amount is the noise reduction curve that is test at the noise reduction microphone, and the curve at the top with higher noise reduction amount is the noise reduction curve at the ear of the wearer. It can be seen that, the noise reduction amount that is actually used at the ear canal opening of the wearer is increased by 3 db.

Figure 7:
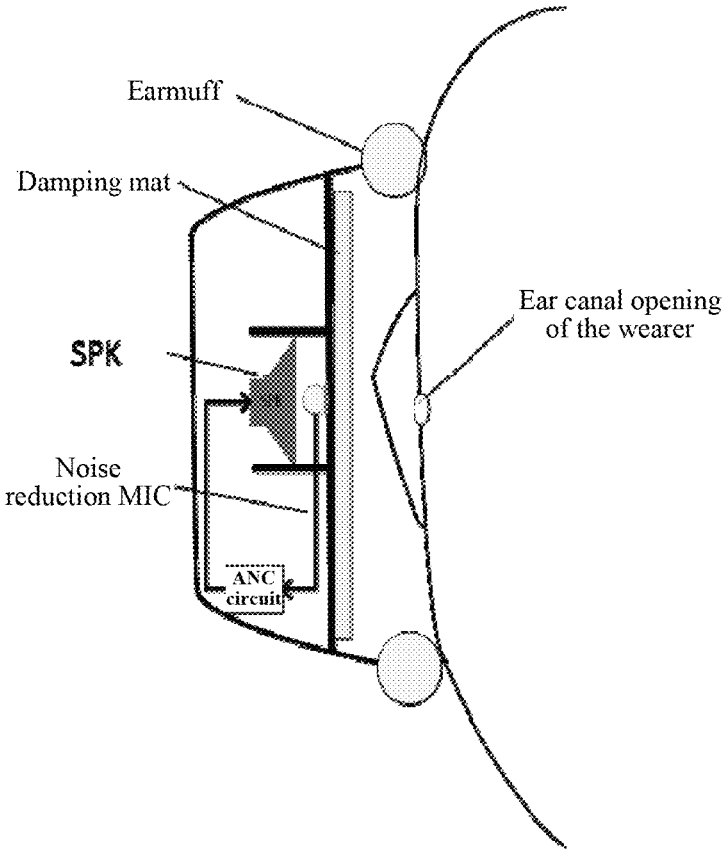
Fig. 7 (Prior Art)
FIG. 7 is the schematic diagram of the technical solution of a conventional circum-aural feedback active noise reduction headphone.
Figure 8:
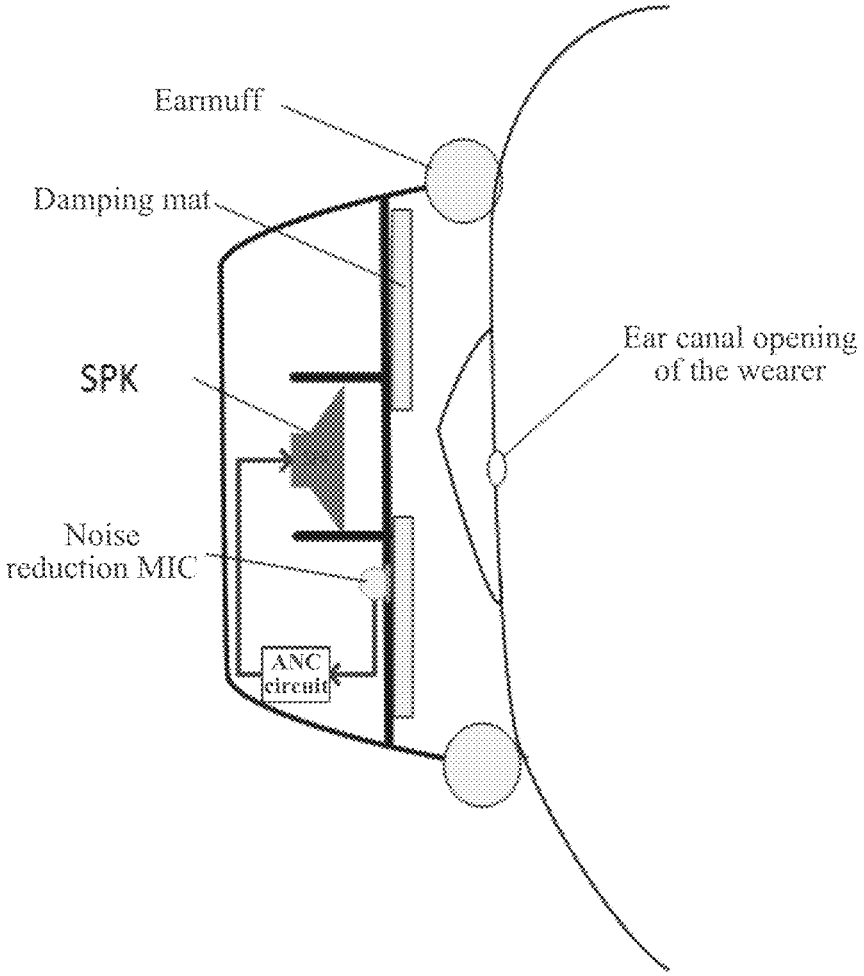
FIG. 8 is the schematic diagram of the technical solution of a circum-aural feedback active noise reduction headphone provided in an embodiment of this Application.

FIG. 7 is the schematic diagram of the technical solution of a conventional circum-aural feedback active noise reduction headphone, and FIG. 8 is the schematic diagram of the technical solution of a circum-aural feedback active noise reduction headphone provided in an embodiment of this Application. As shown in FIGS. 7 and 8, in the circum-aural feedback active noise reduction headphone provided in this Application, unlike the conventional circum-aural feedback active noise reduction headphone, the noise reduction microphone is arranged under a damping mat which is away from directly in front of the loudspeaker, and the loudspeaker faces directly the ear canal opening of the wearer without a damping mat therebetween. When the headphone is worn, if the relative position between the noise reduction microphone and the ear canal opening of the wearer is adjusted, parameters such as g1, g2, the magnitude of the damping between the speaker and the ear canal opening of the wearer, M1 and M2 are adjusted accordingly, and the transfer functions L1 and L2 change along with the adjusting of those parameters, so that an open-loop transfer function at the ear canal opening L2(s0) and an open-loop transfer function at the noise reduction microphone L1(s0) satisfy a relation of |L2(s0)|>|L1(s0)|, to enhance an actual noise reduction amount at the ear canal opening.

The open-loop transfer function at the ear canal opening L2(s0) and the open-loop transfer function at the noise reduction microphone L1(s0) are designed so that when a phase is even times of the circular constant π, the amplitudes of the L1(s0) and the L2(s0) are both less than 1, thereby ensuring the stability of the closed loop system, and avoiding howling.

In conclusion, compared with the prior art, the method for enhancing a noise reduction amount of a feedback active noise reduction headphone and an active noise reduction headphone provided in this Application have the following advantageous effects:

1. The method for enhancing a noise reduction amount of a feedback active noise reduction headphone provided in this Application, by adjusting the position of the noise reduction microphone and the sound transfer function relation of the ear canal opening of the wearer, enhances the closed-loop stability of the feedback system and also enhances the actual noise reduction amount at the ear canal opening of the wearer.

2. The supra-aural feedback active noise reduction headphone provided in this Application solves the problem of thickness increase in the supra-aural earphone or wearing discomfort resulted from installing a noise reduction microphone directly in front of a speaker in the prior art.

3. The circum-aural feedback active noise reduction headphone provided in this Application solves the problem in the prior art that a noise reduction amount is considerably reduced at an ear canal opening of the wearer since a relatively thick filler is used or a circuit gain is attenuated between a speaker and the ear canal opening of the wearer to ensure the system stability.

The above descriptions are merely preferable embodiments of this Application, and are not used to limit the protection scope of this Application. Any modifications, equivalent substitutions or improvements that are made within the principle of this Application shall all be included in the protection scope of this Application.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A method for enhancing noise reduction amount of a feedback active noise reduction headphone, wherein the method comprises:

arranging a noise reduction microphone of the feedback active noise reduction headphone at a position away from directly in front of a loudspeaker; and adjusting a relative position between the noise reduction microphone and an ear canal opening of a wearer, and enabling an open-loop transfer function at the ear canal opening L2(s0) and an open-loop transfer function at the noise reduction microphone L1(s0) to satisfy a relation of |L2(s0)|>|L1(s0)|, to enhance an actual noise reduction amount at the ear canal opening;

wherein, $L_1=HG_1$, $L_2=HG_2$, $G_1=g_1RM_1$, $G_2=g_2RM_2$, $g_1$ is the transfer function of the air between the speaker and the noise reduction microphone, $M_1$ is the sensitivity of the noise reduction microphone, $g_2$ is the transfer function of the air between the speaker and the ear, $M_2$ is the sensitivity at the ear canal opening, H is the control circuit, R is the frequency response of the speaker;

the step of enabling an open-loop transfer function at the ear canal opening L2(s0) and an open-loop transfer function at the noise reduction microphone L1(s0) to satisfy a relation of |L2(s0)|>|L1(s0)| comprises:

enabling a relative quantity B of the open-loop transfer function fall inside a circle) |B+1|=1 in a Nyquist plot of the open-loop transfer function, and B is the difference between the open-loop transfer function at the ear canal opening L2(s0) and the open-loop transfer function at the noise reduction microphone L1(s0);

wherein the method further comprises: designing the open-loop transfer function at the ear canal opening L2(s0) and the open-loop transfer function at the noise reduction microphone L1(s0), so that when a phase of the L1(s0) and the L2(s0) is even times of the circular constant π, the amplitudes of the L1(s0) and the L2(s0) are both controlled to be less than 1.

2. The method according to any one of claim 1, wherein when the method is applied to a supra-aural feedback active noise reduction headphone, the noise reduction microphone is arranged under an earmuff of the supra-aural feedback active noise reduction headphone, and the loudspeaker faces directly the ear canal opening of the wearer.

3. The method according to any one of claim 1, wherein when the method is applied to a circum-aural feedback active noise reduction headphone, the noise reduction microphone is arranged under a damping mat of the circum-aural feedback active noise reduction headphone, and the loudspeaker faces directly the ear canal opening of the wearer without a damping mat therebetween.

4. The method according to claim 3, wherein the damping mat is formed by filling the earmuff with felted wool or compressed sponge.

5. An supra-aural feedback active noise reduction headphone, wherein a noise reduction microphone of the supra-aural feedback active noise reduction headphone is arranged under an earmuff which is away from directly in front of a loudspeaker, and the loudspeaker faces directly the ear canal opening of the wearer; and when the headphone is worn, a relative position between the noise reduction microphone and the ear canal opening of the wearer is adjusted, so that an open-loop transfer function at the ear canal opening L2(s0) and an open-loop transfer function at the noise reduction microphone L1(s0) satisfy a relation of |L2(s0)|>|L1(s0)|, to enhance an actual noise reduction amount at the ear canal opening;

wherein, $L_1=HG_1$, $L_2=HG_2$, $G_1=g_1RM_1$, $G_2=g_2RM_2$, $g_1$ is the transfer function of the air between the speaker and the noise reduction microphone, $M_1$ is the sensitivity of the noise reduction microphone, $g_2$ is the transfer function of the air between the speaker and the ear, $M_2$ is the sensitivity at the ear canal opening, H is the control circuit, R is the frequency response of the speaker;

wherein, the relation of |L2(s0)|>|L1(s0)| comprises:

enabling a relative quantity B of the open-loop transfer function fall inside a circle |B+1|=1 in a Nyquist plot of the open-loop transfer function, and B is the difference between the open-loop transfer function at the ear canal opening L2(s0) and the open-loop transfer function at the noise reduction microphone L1(s0);

designing the open-loop transfer function at the ear canal opening L2(s0) and the open-loop transfer function at the noise reduction microphone L1(s0), so that when a phase of the L1(s0) and the L2(s0) is even times of the circular constant π, the amplitudes of the L1(s0) and the L2(s0) are both controlled to be less than 1.

6. The supra-aural feedback active noise reduction headphone according to claim 5, wherein when a phase of the open-loop transfer function at the ear canal opening L2(s0) and the open-loop transfer function at the noise reduction microphone L1(s0) is even times of the circular constant π, the amplitudes of the L1(s0) and the L2(s0) are both less than 1.

7. A circum-aural feedback active noise reduction headphone, wherein a noise reduction microphone of the circum-aural feedback active noise reduction headphone is arranged under a damping mat which is away from directly in front of a loudspeaker, and the loudspeaker faces directly the ear canal opening of the wearer without a damping mat therebetween; and when the headphone is worn, a relative position between the noise reduction microphone and the ear canal opening of the wearer is adjusted, so that an open-loop transfer function at the ear canal opening L2(s0) and an open-loop transfer function at the noise reduction microphone L1(s0) satisfy a relation of |L2(s0)|>|L1(s0)|, to enhance an actual noise reduction amount at the ear canal opening;

wherein, $L_1=HG_1$, $L_2=HG_2$, $G_1=g_1RM_1$, $G_2=g_2RM_2$, $g_1$ is the transfer function of the air between the speaker and the noise reduction microphone, $M_1$ is the sensitivity of the noise reduction microphone, $g_2$ is the transfer function of the air between the speaker and the ear, $M_2$ is the sensitivity at the ear canal opening, H is the control circuit, R is the frequency response of the speaker wherein, the relation of $|L_2(s0)|>|L_1(s0)|$ comprises:

enabling a relative quantity B of the open-loop transfer function fall inside a circle |B+1|=1 in a Nyquist plot of the open-loop transfer function, and B is the difference between the open-loop transfer function at the ear canal opening L2(s0) and the open-loop transfer function at the noise reduction microphone L1(s0);

designing the open-loop transfer function at the ear canal opening L2(s0) and the open-loop transfer function at the noise reduction microphone L1(s0), so that when a phase of the L1(s0) and the L2(s0) is even times of the circular constant π, the amplitudes of the L1(s0) and the L2(s0) are both controlled to be less than 1.

8. The circum-aural feedback active noise reduction headphone according to claim 7, wherein when a phase of the open-loop transfer function at the ear canal opening L2(s0) and the open-loop transfer function at the noise reduction microphone L1(s0) is even times of the circular constant π, the amplitudes of the L1(s0) and the L2(s0) are both less than 1.

* * * * *